US006767269B1

(12) United States Patent
Liu

(10) Patent No.: US 6,767,269 B1
(45) Date of Patent: Jul. 27, 2004

(54) STEEL TOY DISK

(76) Inventor: Kuo-Ching Liu, No. 43 Wugung 6$^{th}$ Rd., Wugu Shiang, Taipei (TW)

( * ) Notice: Subject to any disclaimer, the term of this patent is extended or adjusted under 35 U.S.C. 154(b) by 0 days.

(21) Appl. No.: 10/726,664

(22) Filed: Dec. 4, 2003

(51) Int. Cl.$^{7}$ ..... B44C 5/00
(52) U.S. Cl. ..... 446/71; 446/491
(58) Field of Search ..... 446/46, 47, 48, 446/71, 147, 491; 273/148 R

(56) References Cited

U.S. PATENT DOCUMENTS 4,467,933 A * 8/1984 Wilkinson et al. ..... 220/623
6,112,698 A * 9/2000 Zelinger ..... 119/61.54

* cited by examiner

*Primary Examiner*—Jacob K. Ackun, Jr.
(74) *Attorney, Agent, or Firm*—Troxell Law Office PLLC

(57) ABSTRACT

A steel toy disk has patterns or designs printed on an upper surface thereof, and includes a curled and upward protruded rim and a raised central portion formed through punching. A top of the raised central portion is located between a bottom of the steel toy disk and a top of the curled rim. The raised central portion produces a three-dimensional effect on the printed patterns or designs, and gives the steel toy disk an increased structural strength to protect the steel toy disk from deformation under impact of an external force.

2 Claims, 2 Drawing Sheets

STEEL TOY DISK

FIELD OF THE INVENTION

The present invention relates to a steel toy disk, and more particularly to a steel toy disk having a raised or depressed central portion formed through punching, and thereby produce a three-dimensional effect on patterns or designs printed on an upper surface of the steel toy disk.

BACKGROUND OF THE INVENTION

A general steel toy disk is a flat member having patterns or designs printed on an upper surface thereof and includes a curled and upward protruded rim. Children are attracted to the printed patterns or designs to collect and play the steel toy disk. The steel toy disk is conventionally a flat disk and the patterns or designed printed thereon do not create a three-dimensional effect. Therefore, it is desirable to develop a steel toy disk having printed patterns or designs that produce a three-dimensional effect to increase the value and recreational effect of the steel toy disk.

SUMMARY OF THE INVENTION

A primary object of the present invention is to provide a steel toy disk having printed patterns or designs that produces a three-dimensional effect. To achieve the above and other objects, the steel disk toy of the present invention has patterns or designs printed on an upper surface thereof, and includes a curled and upward protruded rim and a raised central portion formed through punching. A top of the raised central portion is located between a bottom of the steel toy disk and a top of the curled rim. The raised central portion produces a three-dimensional effect on the printed patterns or designs, and gives the steel toy disk an increased structural strength to protect the steel toy disk from deformation under impact of an external force.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
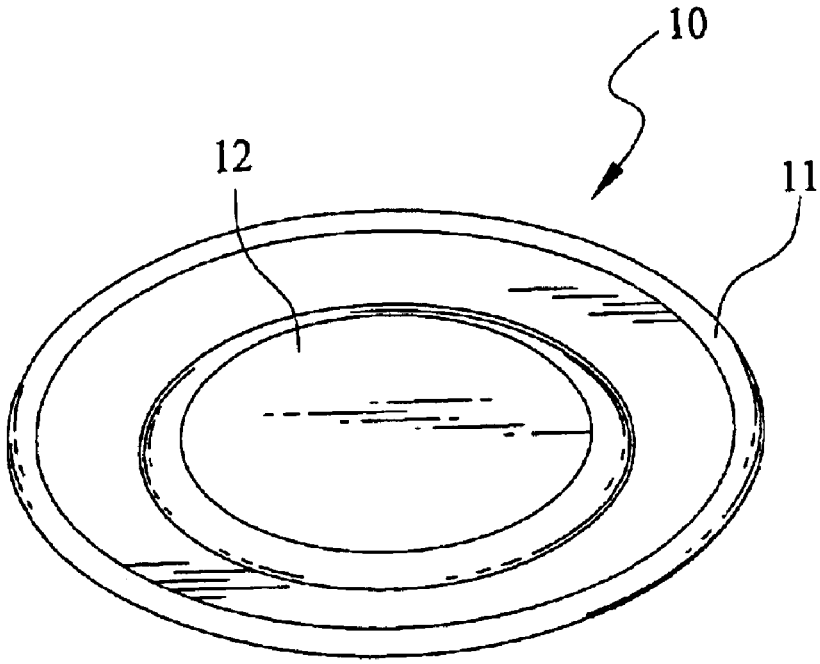
FIG. 1 is a top perspective view of a steel toy disk according to a first embodiment of the present invention.
Figure 2:
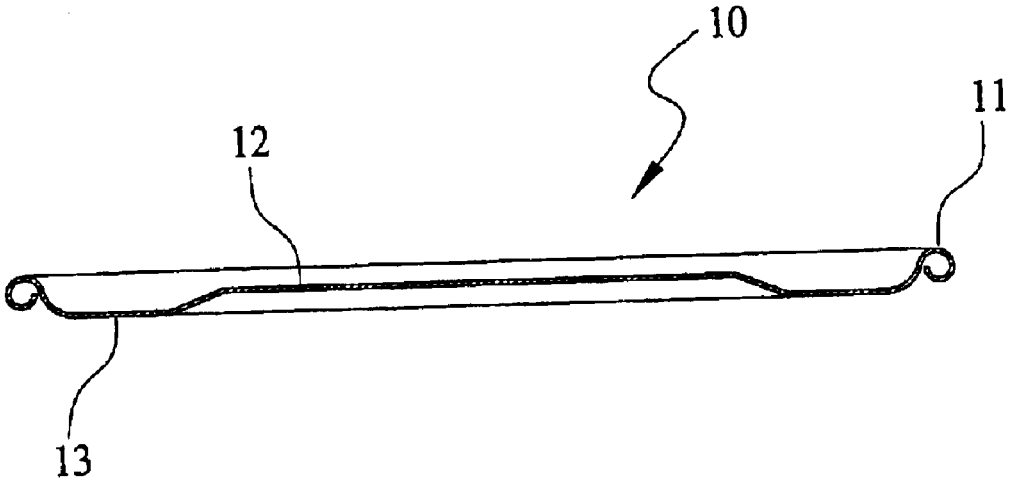
FIG. 2 is a sectional view of FIG. 1.

Please refer to FIG. 1 that shows a steel toy disk 10 according to a first embodiment of the present invention. As shown, the steel toy disk 10 is a flat round member having patterns or designs printed on an upper surface thereof. The steel toy disk 10 includes a curled and upward protruded rim 11, and is punched to form a raised central portion 12. As can be seen from FIG. 2, a top of the raised central portion 12 is located between a bottom 13 of the toy disk 10 and a top of the curled rim 11. With the raised central portion 12, a three-dimensional effect is produced on patterns or designs printed on the upper surface of the steel toy disk 10. The raised central portion 12 also gives the steel toy disk an increased structural strength to protect the steel toy disk 10 against deformation under impact by an external force.

In the illustrated first embodiment, the raised central portion 12 maybe of any configuration, such as a round, a triangular, or a diamond shape. And, the printed patterns or designs may be, for example, cartoon figures.

Figure 3:
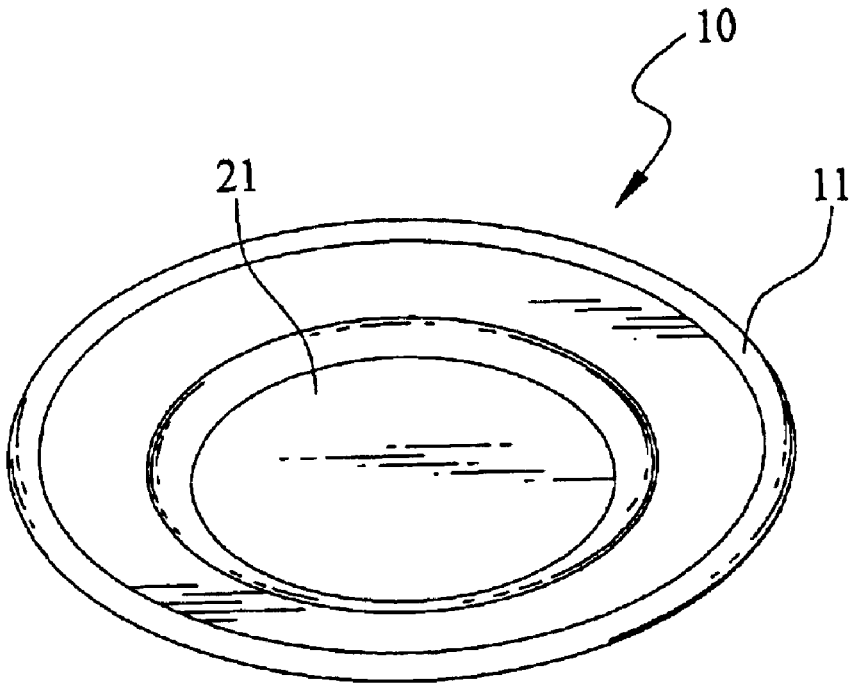
FIG. 3 is a top perspective view of a steel toy disk according to a second embodiment of the present invention.
Figure 4:
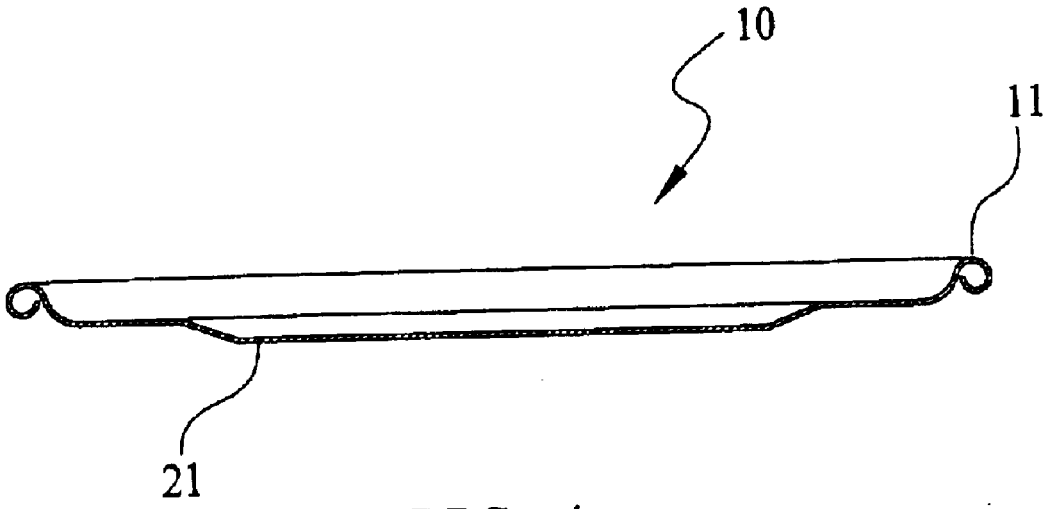
FIG. 4 is a sectional view of FIG. 3.

FIGS. 3 and 4 are top perspective and sectional views, respectively, of a steel toy disk 10 according to a second embodiment of the present invention. The steel toy disk 10 in the second embodiment is also a flat round member having patterns or designs printed on an upper surface thereof, and a curled and upward protruded rim 11. The steel toy disk 10 in the second embodiment is punched to form a depressed central portion 21 downward projected from a bottom of the steel toy disk 10. With the depressed central portion 21, a three-dimensional effect is produced on the patterns or designs printed on the upper surface of the steel toy disk 10. Meanwhile, a lower surface of the depressed central portion 21 may serve as a stamp.

In the illustrated second embodiment, the depressed central portion 21 may be of any configuration, such as a round, a triangular, or a diamond shape, and the patterns or designs may be, for example, beautiful scenery.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A steel toy disk, comprising a flat round body having patterns or designs printed on an upper surface thereof; said flat round body including a curled and upward protruded rim, and a raised central portion formed through punching; a top of said raised central portion being located between a bottom of said flat round body and a top of said curled rim; said raised central portion producing a three-dimensional effect on said printed patterns or designs, and giving said steel toy disk an increased structural strength to protect said steel toy disk from deformation under impact of an external force.

2. A steel toy disk, comprising a flat round body having patterns or designs printed on an upper surface thereof; said flat round body including a curled and upward protruded rim, and a depressed central portion formed through punching; said depressed central portion producing a three-dimensional effect on said printed patterns or designs; and a lower surface of said depressed central portion being adapted to serve as a stamp.

* * * * *